US010629986B2

(12) United States Patent
Conrad

(10) Patent No.: US 10,629,986 B2
(45) Date of Patent: Apr. 21, 2020

(54) PORTABLE ANTENNA SYSTEM WITH MANUAL ELEVATION ADJUSTMENT

(71) Applicant: Winegard Company, Burlington, IA (US)

(72) Inventor: Timothy John Conrad, Mount Pleasant, IA (US)

(73) Assignee: Winegard Company, Burlington, IA (US)

( * ) Notice: Subject to any disclaimer, the term of this patent is extended or adjusted under 35 U.S.C. 154(b) by 143 days.

(21) Appl. No.: 15/997,954

(22) Filed: Jun. 5, 2018

(65) Prior Publication Data

US 2019/0131698 A1 May 2, 2019

Related U.S. Application Data

(60) Provisional application No. 62/540,964, filed on Aug. 3, 2017.

(51) Int. Cl.

| | |
|---|---|
| ***H01Q 1/12*** | (2006.01) |
| ***H01Q 1/24*** | (2006.01) |
| ***H01Q 1/42*** | (2006.01) |
| ***H01Q 3/08*** | (2006.01) |
| *H01Q 15/16* | (2006.01) |

(52) U.S. Cl.

CPC ..... *H01Q 1/428* (2013.01); *H01Q 1/125* (2013.01); *H01Q 3/08* (2013.01); *H01Q 15/16* (2013.01)

(58) Field of Classification Search

CPC ..... H01Q 15/16; H01Q 1/12; H01Q 1/125; H01Q 1/42; H01Q 1/428; H01Q 3/02; H01Q 3/08; H01Q 15/20

See application file for complete search history.

(56) References Cited

U.S. PATENT DOCUMENTS

| | | | | |
|---|---|---|---|---|
| 2,827,629 | A * | 3/1958 | Rounsefell | H01Q 1/125 343/878 |
| 3,552,836 | A | 1/1971 | Oskam | |
| 4,659,053 | A | 4/1987 | Holley et al. | |
| 5,077,560 | A | 12/1991 | Horton et al. | |
| 5,334,990 | A * | 8/1994 | Robinson | H01Q 1/1235 343/840 |
| 5,485,170 | A | 1/1996 | McCarrick | |
| 5,646,638 | A | 7/1997 | Winegard et al. | |
| 5,819,185 | A * | 10/1998 | Umezawa | H01Q 3/06 455/575.1 |
| 5,945,945 | A | 8/1999 | Wagner et al. | |
| 5,975,472 | A | 11/1999 | Hung | |

(Continued)

*Primary Examiner* — Tho G Phan

(74) *Attorney, Agent, or Firm* — Dorr, Carson & Birney PC

(57) ABSTRACT

A portable antenna system has a dish antenna mounted to an antenna support platform and enclosed within a radome. The elevation and azimuth of the antenna can be adjustably directed over a range of angles with respect to the antenna support platform by a controller with electric motors. The antenna support platform is hinged at its periphery to a base. The hinge allows the antenna support platform and antenna to pivot upward with respect to the base between a stowed state in which the antenna support platform rests against the base, and a desired angle of elevation in a raised state. A prop extending between the base and antenna support platform holds the antenna support platform at the design elevation angle in the raised state. Optionally, this prop can allow an adjustable elevation angle.

11 Claims, 4 Drawing Sheets

(56) References Cited

U.S. PATENT DOCUMENTS

| | | | | |
|---|---|---|---|---|
| 6,172,650 | B1 | 1/2001 | Ogawa et al. | |
| 6,478,274 | B1 | 11/2002 | Oddsen | |
| 6,505,988 | B1 | 1/2003 | Oddsen | |
| 6,538,612 | B1 | 3/2003 | King | |
| 6,559,806 | B1 | 5/2003 | Watson | |
| 7,113,144 | B2 | 9/2006 | Lin et al. | |
| 7,800,545 | B2 * | 9/2010 | Jayasuriya | H04B 7/1853 343/702 |
| 8,200,150 | B2 * | 6/2012 | Lopez | H01Q 1/1257 333/223 |
| 9,000,999 | B2 * | 4/2015 | Venghaus | H01Q 1/42 343/840 |
| 2001/0046258 | A1 * | 11/2001 | Wise | H01Q 1/084 375/219 |
| 2004/0169114 | A1 | 9/2004 | Dierkes | |
| 2007/0052607 | A1 * | 3/2007 | Dwornik | H01Q 3/08 343/766 |
| 2016/0013562 | A1 | 1/2016 | Yang et al. | |
| 2017/0293206 | A1 | 10/2017 | Wood | |

* cited by examiner

PORTABLE ANTENNA SYSTEM WITH MANUAL ELEVATION ADJUSTMENT

RELATED APPLICATION

The present application is based on and claims priority to the Applicant's U.S. Provisional Patent Application 62/540,964, entitled "Portable Antenna System With Manual Elevation Adjustment," filed on Aug. 3, 2017.

BACKGROUND OF THE INVENTION

Field of the Invention

The present invention relates generally to the field of portable antenna systems. More specifically, the present invention discloses an automatic antenna system with a manual elevation adjustment mechanism to complement the range of elevation angles provided by the antenna's automatic control system.

Statement of the Problem

Compact, portable dish antenna systems have been used for many years. For example, portable dish antennas are commonly employed for military applications, in the oil and gas industry and on recreational vehicles. One common configuration has a small dish antenna housed within a protective enclosure defined by a radome and base. The direction of the antenna is adjusted by a controller operating small electric motors that can move the antenna within the radome over a range of elevation and azimuth angles.

The range of azimuth adjustment is not a significant concern because the entire assembly can easily be manually rotated about its vertical axis to point the antenna in any desired azimuth direction. However, elevation adjustment is inherently limited by dimensional constraints of the dish within the radome. The size of the overall assembly is always a concern in designing portable antenna systems. The size of the radome should be kept as small as possible, but the dish within the radome must have certain minimum dimensions to meet its functional requirements as an antenna. As a result, the lower radome height will limit the system to more modest ranges of elevation (e.g., +/− 30° from vertical).

Solution to the Problem

The present invention addresses this issue by providing a manual elevation adjustment for the dish antenna in addition to the range of elevation adjustment provided by the controller and motors associated with the antenna. These two ranges of elevation adjustment are additive, so the overall range of elevation adjustment for the dish antenna is significantly increased. For example, the manual elevation adjustment can either be a fixed angle (e.g.) 45° or adjustable of a range of elevation angles (e.g., 0-45°).

SUMMARY OF THE INVENTION

This invention provides a portable antenna system having a dish antenna mounted to an antenna support platform and enclosed within a radome. The elevation and azimuth of the antenna can be adjustably directed over a range of angles with respect to the antenna support platform by a controller with electric motors. The antenna support platform is hinged at its periphery to a base. This hinge allows the antenna support platform and antenna to pivot upward with respect to the base between a stowed state in which the antenna support platform rests against the base, and a desired angle of elevation in a raised state. A prop extending between the base and antenna support platform holds the antenna support platform at the design elevation angle in the raised state. Optionally, this prop can allow an adjustable elevation angle.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
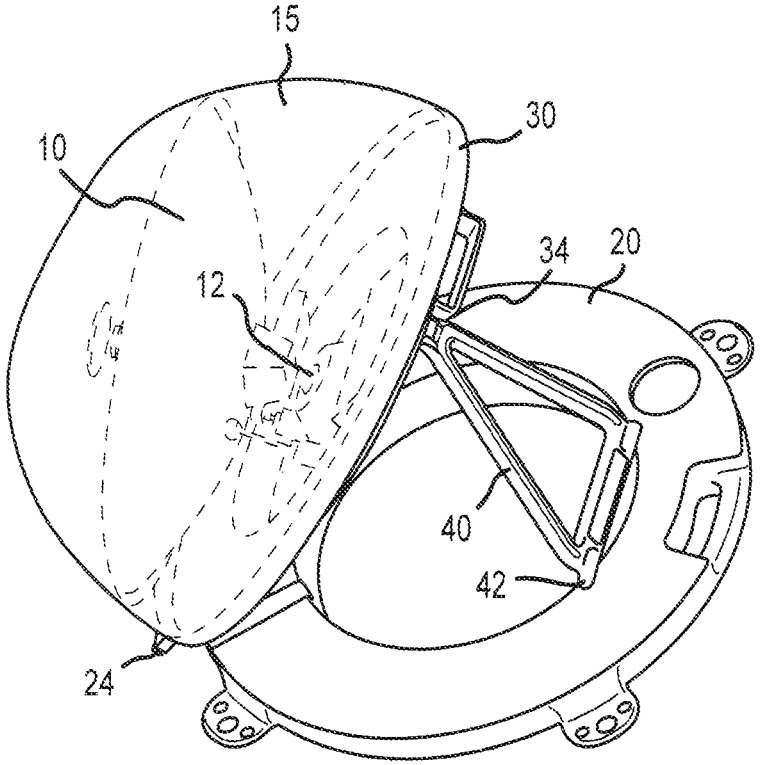
FIG. 1 is a top axonometric view of an embodiment of the present antenna system in its deployed state.
Figure 2:
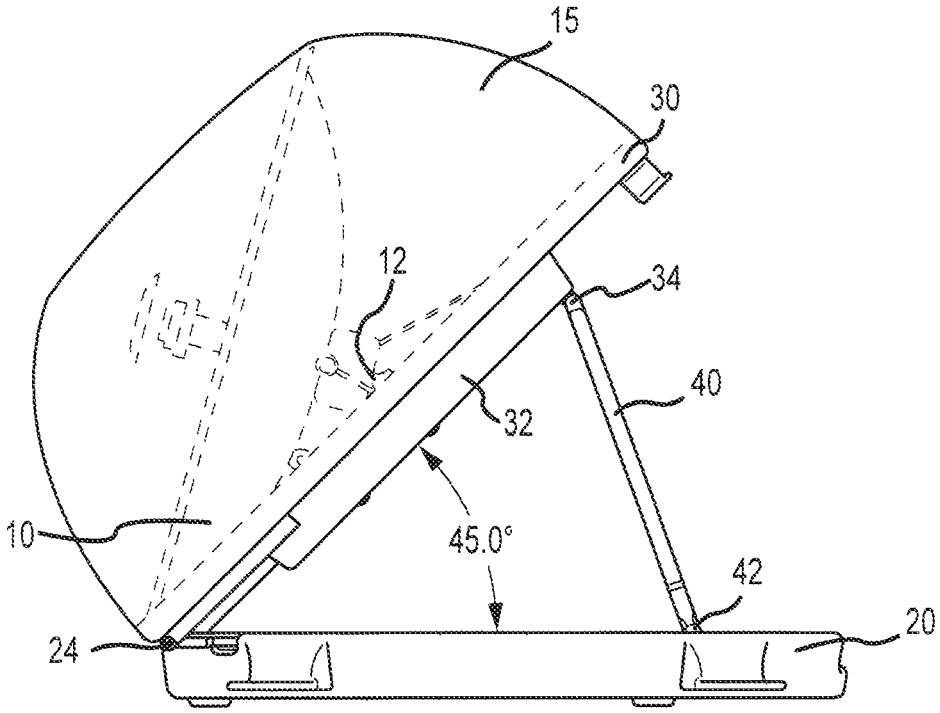
FIG. 2 is a right side view corresponding to FIG. 1.
Figure 3:
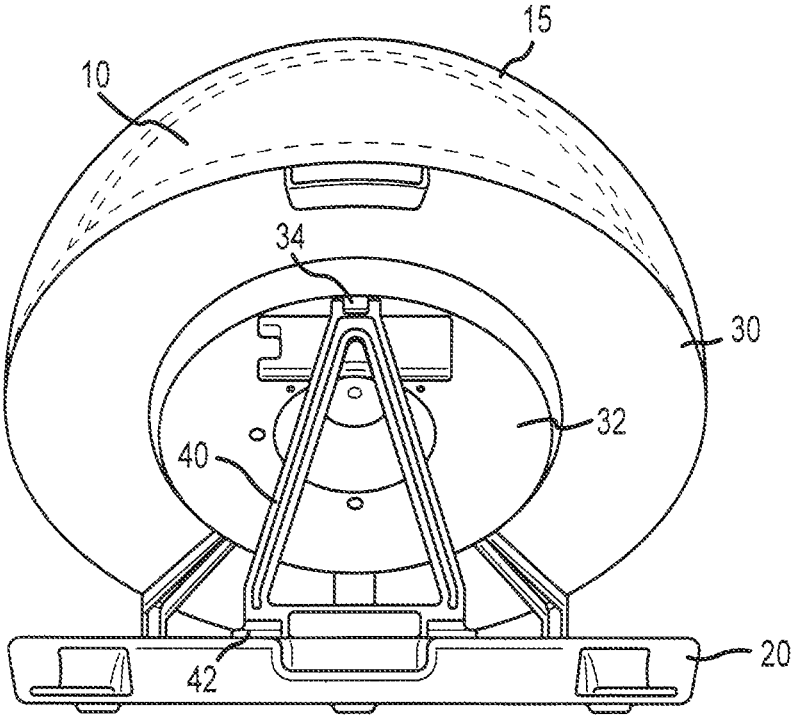
FIG. 3 is a rear view corresponding to FIG. 1.

Turning to FIG. 1, a top axonometric view is provided of a portable antenna system embodying the present invention. Corresponding right side and rear views are illustrated in FIGS. 2 and 3, respectively. The assembly includes an antenna 10 (e.g., a dish antenna) within a radome 15. The antenna 10 and radome 15 are supported on an antenna support platform 30, which in turn, is supported by a base 20.

The elevation and azimuth of the antenna 10 can be adjustably directed over a range of angles with respect to the antenna support platform 30 by a controller with electric motors 12. In particular, at least one of these motors 12 serves as an elevation control motor allowing the elevation of the antenna 10 to be adjustably directed by the controller over a range of elevation angles with respect to the plane of the antenna support platform 30.

The antenna support platform 30 and radome 15 form an enclosure around the antenna 10 and its controller and motors 12 to protect these components from damage and the environment. The radome 15 can be generally dome-shaped and extends upward from the periphery of the antenna support platform 30 to enclose the antenna 10.

The antenna support platform 30 can be circular disk that provides a platform for mounting the antenna 10 and its controller and motors 12. However, the embodiment of the antenna support platform 30 shown in the accompanying drawings includes a central recessed portion 32 that protrudes slightly outward (or downward) to yield more room within the radome 15 to house the antenna 10, controller and motors 12. In particular, this recess 32 can be used to mount the base of the antenna 10, and to receive a portion of the body of the antenna 10 in the stowed state.

Figure 4:
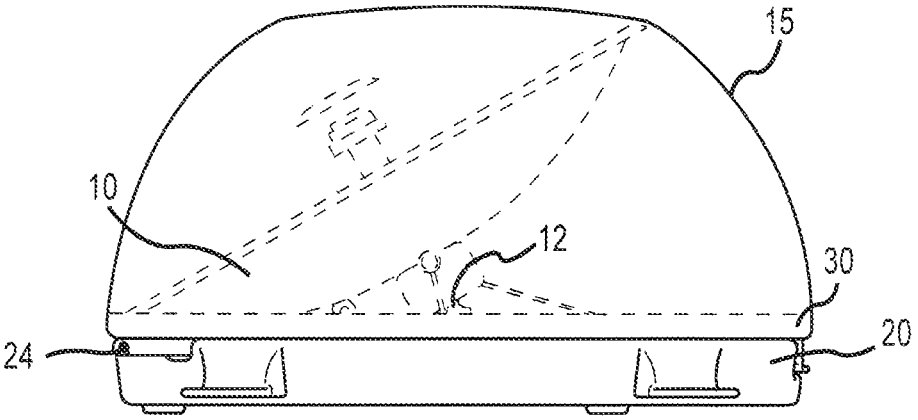
FIG. 4 is a right side view of the antenna system in its stowed state.
Figure 5:
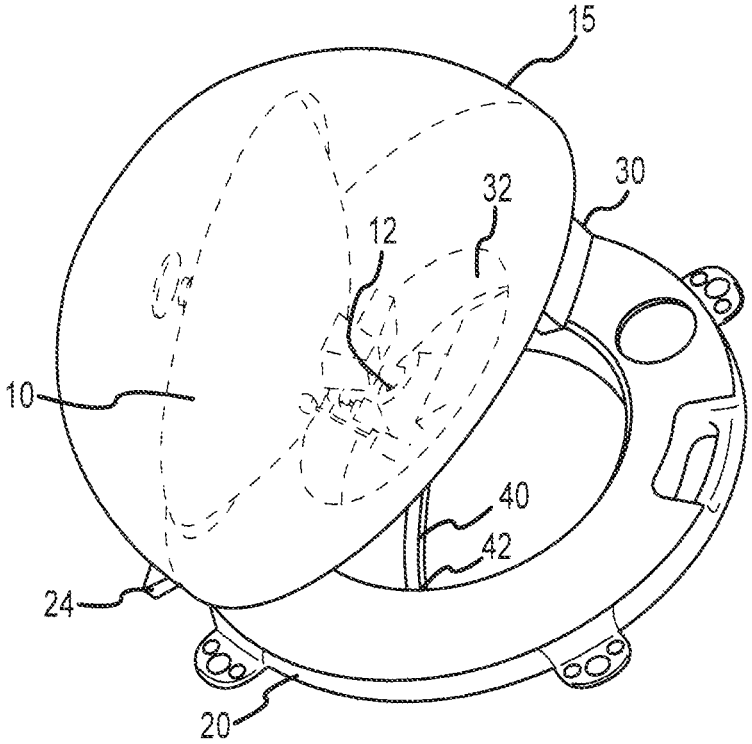
FIG. 5 is a top axonometric view of another embodiment of the antenna system in its deployed state.
Figure 6:
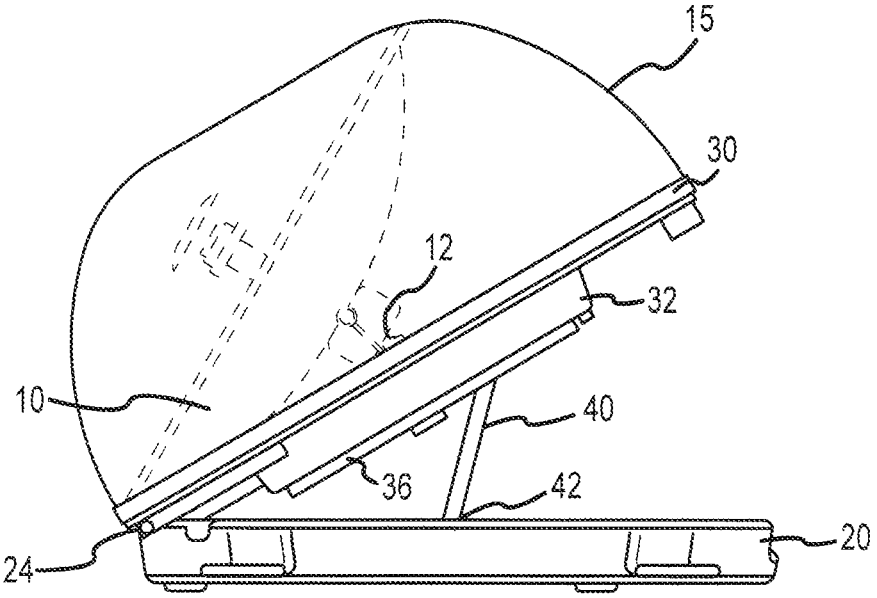
FIG. 6 is a right side view corresponding to FIG. 5.

In the embodiment shown in the accompanying figures, the base 20 has a generally annular shape that can be filled with ballast for stability. A hinge 24 connects the peripheral edges of the base 20 and antenna support platform 30 so that the antenna support platform 30 can pivot upward to a desired angle of elevation with respect to the base 20 in the raised state as shown in FIG. 2. The antenna support platform 30 rests against the base 20 in the stowed state as shown in FIG. 4. The void in the center of the annular base 20 receives the protruding underside of the recessed portion 32 of the antenna support platform 30 when it is pivoted flat against the base 20 in its stowed state as shown in FIG. 4.

FIGS. 1-4 show an embodiment of the present invention in which a prop 40 holds the antenna support platform 30 at a fixed elevation angle with respect to the base 20 when deployed. In this embodiment, the upper end of the prop 40 is removably secured by a clasp 34 on the underside of the antenna support platform 30 to maintain this fixed angle in the deployed state. When not deployed, the prop 40 can be released from the clasp and pivoted downward about the hinge 42 at the prop's lower end, so the prop 40 can be stored between the base 20 and antenna support platform 30. In this stowed state, the radome 15, antenna support platform 30 and base 20 form a compact unit, as shown in FIG. 4, that is easy to lift and transport.

Alternatively, the prop 40 could be hinged at its upper end to the underside of the antenna support platform 30. The lower end of the prop 40 removably engages a recess in the base 20 when deployed. The prop 40 can pivot about its upper end while the lower end is manually lifted up and out of the recess in the base 20. Once released from the base 20, the prop 40 folds upward against the underside of the antenna support platform 30, and can be stored between the base 20 and antenna support platform 30 in the stowed state.

Figure 7:
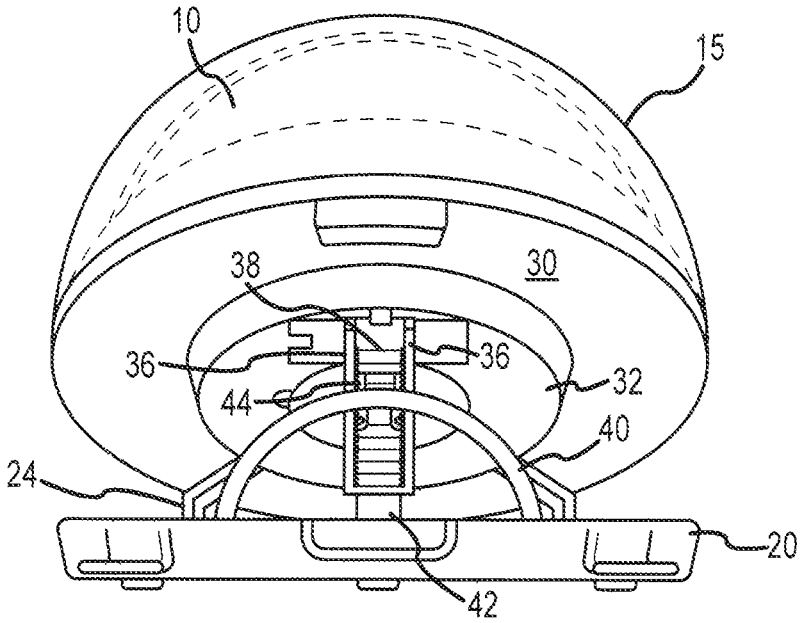
FIG. 7 is a rear view corresponding to FIG. 5.
Figure 8:
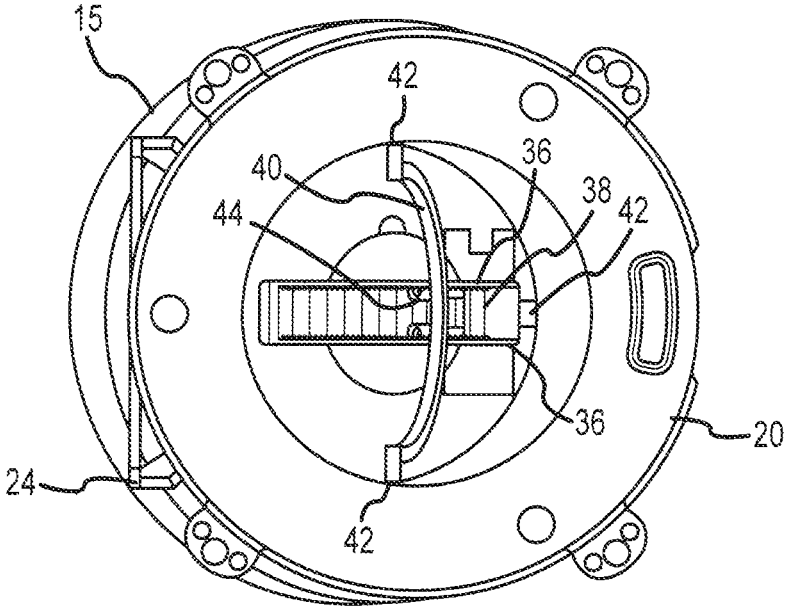
FIG. 8 is a bottom axonometric view corresponding to FIG. 5.

FIGS. 5-8 show an alternative embodiment of the present invention in which the upper end of the prop 40 is hinged to a slider mechanism 44 that allows an adjustable range of raised positions with a range of elevation angles between the base 20 and antenna support platform 30. In this embodiment, the prop 40 is curved to fit into the void in the center of the base 20 when stowed. The slider 44 at the upper end of the prop 40 slides along a pair of tracks 36 on the underside of the antenna support platform 30 as illustrated in FIGS. 7 and 8 to adjust the elevation angle of the antenna support platform 30. For example, the slider 44 can be held in place by a friction fit between the tracks 36 until tabs on the slider 44 are pinched together to release the slider 44 and allow it to slide along the tracks 36. Alternatively, the slider 44 could be adjustably held in place in the tracks 36 by a series of protrusions, teeth or detents spaced along the tracks 36. The tracks 36 can also be equipped with a series of visual indicia 38 (i.e., a scale) indicating the elevation angle of the antenna support platform 30 as the slider 44 is moved along the tracks 36.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A portable antenna system comprising:

a portable base having a peripheral edge around a void;

an antenna support platform with a peripheral edge hinged to the peripheral edge of the base to allowing the antenna support platform to pivot upward from a stowed state against the base, to a raised state in which the antenna support platform is elevated to an angle with respect to the base; and a recess resulting in a protruding underside of the antenna support platform that is received by the void in the base in the stowed state;

a prop for supporting the antenna support platform in the raised state with respect to the base;

an antenna mounted to the antenna support platform with a portion of the antenna being received in the recess of the antenna support platform in the stowed state;

an elevation control motor adjusting the elevation of the antenna with respect to the antenna support platform; and a radome extending from the antenna support platform and enclosing the antenna.

2. The portable antenna system of claim 1 wherein the base, antenna support platform and radome form a portable unit enclosing the antenna in the stowed state.

3. The portable antenna system of claim 1 further comprising at least one track on the antenna support platform, and a slider on the prop slidably engaging the track to allow adjustment of angle of elevation of the antenna support platform with respect to the base.

4. The portable antenna system of claim 1 wherein the prop further comprises a lower end hinged to the base so that the prop pivots against the base in the stowed state.

5. The portable antenna system of claim 1 wherein the antenna support platform further comprises a clasp removably engaging the prop in the raised state.

6. A portable antenna system comprising:

a portable base having a peripheral edge;

an antenna support platform with a peripheral edge hinged to the peripheral edge of the base to allowing the antenna support platform to pivot upward from a stowed state against the base, to a range of raised states in which the antenna support platform is elevated with respect to the base;

at least one track on the antenna support platform;

a prop for supporting the antenna support platform in a range of raised states with respect to the base, with a slider slidably engaging the track to allow adjustment of angle of elevation of the antenna support platform with respect to the base;

an antenna mounted to the antenna support platform;

an elevation control motor adjusting the elevation of the antenna with respect to the antenna support platform; and a radome extending from the antenna support platform and enclosing the antenna.

7. The portable antenna system of claim 6 wherein the antenna support platform further comprises a recess for receiving a portion of the antenna in the stowed state.

8. The portable antenna system of claim 7 wherein the recess results in a protruding underside of the antenna support platform, and the base further comprises a void to receive the protruding underside of the antenna support platform in the stowed state.

9. The portable antenna system of claim 6 wherein the base, antenna support platform and radome form a portable unit enclosing the antenna in the stowed state.

10. The portable antenna system of claim 6 wherein the prop further comprises a lower end hinged to the base so that the prop pivots against the base in the stowed state.

11. A portable antenna system comprising:

a portable base having a peripheral edge;

an antenna support platform with a peripheral edge hinged to the peripheral edge of the base to allowing the antenna support platform to pivot upward from a stowed state against the base, to a raised state in which the antenna support platform is elevated to an angle with respect to the base; and having a clasp;

a prop for supporting the antenna support platform in the raised state with respect to the base, and being removably engaged by the clasp in the raised state;

an antenna mounted to the antenna support platform;

an elevation control motor adjusting the elevation of the antenna with respect to the antenna support platform; and a radome extending from the antenna support platform and enclosing the antenna.

* * * * *